United States Patent [19]

Hunder et al.

[11] Patent Number: 5,052,872

[45] Date of Patent: Oct. 1, 1991

[54] MANUAL SHEET BINDING STRUCTURE AND METHOD

[75] Inventors: Ray A. Hunder, Birchwood; Stephen H. Dwyer, Egan; George J. Clements, Afton, all of Minn.; Michael K. Martin, West Lake, Ohio

[73] Assignee: Minnesota Mining and Manufacturing Company, St. Paul, Minn.

[21] Appl. No.: 359,504

[22] Filed: Jun. 1, 1989

[51] Int. Cl.[5] ..... B42D 1/04; B42D 3/00; B42C 9/00; B42C 11/00

[52] U.S. Cl. ..... 412/6; 281/15.1; 281/21.1; 281/16; 281/28; 281/29; 281/35; 281/36; 281/51; 412/2; 412/4; 412/8

[58] Field of Search ..... 281/21.1, 15.1, 28, 281/29, 35, 36, 51, 16; 283/63.1, 64; 412/4, 8, 36, 901, 2, 5, 6

[56] References Cited

U.S. PATENT DOCUMENTS

| | | | |
|---|---|---|---|
| 848,680 | 4/1907 | Nelson . | |
| 1,765,194 | 6/1930 | Von Auw . | |
| 2,455,971 | 12/1948 | Bosch | 11/1 |
| 3,188,114 | 6/1965 | O'Brien et al. | 281/31 |
| 3,210,093 | 10/1965 | Steidinger | 281/21 |
| 3,825,963 | 6/1974 | Abildgaard et al. | 412/901 |
| 3,891,240 | 6/1975 | DuCorday | 281/29 |
| 3,912,304 | 10/1975 | Abildgaard et al. | 281/29 |
| 4,083,582 | 4/1978 | Villafana | 281/29 |
| 4,518,296 | 5/1985 | Pearson et al. | 412/37 |
| 4,673,324 | 6/1987 | Hanson et al. | 412/6 |
| 4,762,341 | 8/1988 | Rabuse | 281/29 |
| 4,800,110 | 1/1989 | DeCorday | 428/43 |

FOREIGN PATENT DOCUMENTS

| | | | |
|---|---|---|---|
| 1097407 | 1/1961 | Fed. Rep. of Germany . | |
| 1961040 | 2/1979 | Fed. Rep. of Germany | 412/901 |
| 1126667 | 6/1956 | France . | |

*Primary Examiner*—Paul A. Bell

*Attorney, Agent, or Firm*—Gary L. Griswold; Walter N. Kirn; William L. Huebsch

[57] ABSTRACT

A method for binding a stack of fan folded sheets including manually disposing the stack of sheets with spine edges of the sheets generally aligned in a plane generally at a right angle to the side surfaces of the sheets in the stack; manually positioning a thick layer of pressure sensitive adhesive already adhered to a generally planar portion of a highly flexible backing having low resiliency over the spine edges; and manually pressing the side of the backing against the spine edge of the sheets to cause conformation of the backing and adhesion of the layer of pressure sensitive adhesive to the spine edges of the sheets, which is most easily done by manually pressing the spine edges of the sheets toward an edge of a structure such as a table or desk with the edge disposed transverse of the spine edges of the sheets along the surface of the backing opposite the layer of pressure sensitive adhesive while moving the spine edges longitudinally to bring the majority of the side of the backing opposite the layer of pressure sensitive adhesive progressively into engagement with the edge.

22 Claims, 4 Drawing Sheets

MANUAL SHEET BINDING STRUCTURE AND METHOD

TECHNICAL FIELD

The present invention relates to sheet binding structures including pressure sensitive adhesive and methods for binding sheets, and particularly to methods for binding a stack of generally uniformly sized connected sheets of the type sometimes called continuous forms, folded or fan folded sheets (called connected fan folded sheets herein), each of which sheets in the stack has a spine edge opposite an outer edge and, except for the outermost sheets which are each joined along only one edge, is joined at its edges (typically along lines of perforations) to sheets adjacent its major surfaces in the stack with the spine edge of the sheet joined to the spine edge of the sheet along one of its side surfaces and the outer edge of the sheet joined to the outer edge of the sheet along the other of its side surfaces.

BACKGROUND ART

The art describes structures and methods for binding stacks of sheets including such connected fan folded sheets using adhesive, which structures and methods produce various types of bound books. U.S. Pat. No. 3,188,114 describes such a structure including a layer of pressure sensitive adhesive already adhered to a backing that can be adhered over the spine edges so that the backing and layer of pressure sensitive adhesive bind the stack into a book.

While such structures and methods may produce a useful bound book that can be formed by persons with no particular binding skill in an office or in a home without the need for passing mechanical binding devices through openings in the sheets that can obstruct information on the sheets and restrict easy opening of the book, known systems of this type have required a more complex cover structure than may be desired.

DISCLOSURE OF THE INVENTION

The present invention provides simple and effective methods and assemblies for binding stacks of sheets particularly including stacks of connected fan folded sheets (i.e., stacks up to more than 3 inches thick) using pressure sensitive adhesive, which assemblies persons in an office or a home with no particular binding skill can use without the need of binding devices to form bound books from such a stack, and which bound books formed using the assemblies are securely bound and can lay completely open with all portions of the sheets to which the book is opened parallel to afford easy reading of information on the sheets from edge to edge.

The method according to the present invention for binding a stack of generally uniformly sized sheets, such as connected fan folded sheets, comprises the steps of (1) disposing the stack of sheets in a position with the spine edges of the sheets generally aligned in a plane generally at a right angle to the side surfaces of sheets, (2) manually positioning a generally planar uniformly thick layer of pressure sensitive adhesive already adhered to a generally planar portion of a highly flexible backing having low resiliency over the spine edges; and (3) manually pressing the side of the backing against the spine edge of the sheets to cause conformation of the backing and adhesion of the layer of pressure sensitive adhesive to the spine edges of the sheets, which pressing could be done by manually rubbing a squeegee along the backing, but preferably is done by manually pressing the spine edges of the sheets toward an edge of a structure such as a table or desk with the edge disposed transverse of the spine edges of the sheets along the side of the backing opposite the layer of pressure sensitive adhesive while moving the spine edges longitudinally to bring the majority of the side of the backing opposite the layer of pressure sensitive adhesive progressively into engagement with the edge.

The method can be performed using a novel binding assembly including the backing, the layer of pressure sensitive adhesive adhered to the backing, a narrow release liner releasably adhered over a narrow strip of the pressure sensitive adhesive adjacent and along one edge of the backing, and a large release liner including a major portion releasably adhered over the portion of the layer of pressure sensitive adhesive not covered by the narrow release liner and a minor portion projecting past the adjacent edge of the narrow release liner. The method then further includes (4) removing the narrow release liner and adhering the exposed narrow portion of the pressure sensitive adhesive to a portion of the outer surface of one outermost sheet in the stack adjacent its spine edge with the backing projecting past its spine edge; (5) positioning the side opposite the stack of the sheet to which the backing is adhered on a support surface; (6) manually pressing said sheets together adjacent the spine edge and against the support surface by pressing on the side of the stack opposite the sheet to which the backing is adhered while manually pulling the minor portion of the large release liner upwardly along the spine surfaces to progressively peel the large liner away from the layer of pressure sensitive adhesive and position the layer of pressure sensitive adhesive smoothly along the spine edges of the sheets to provide said positioning step; and (7) manually adhering an edge portion of the backing opposite the sheet to which the backing was adhered to a portion of the sheet on the opposite side of the stack between the positioning step and the pressing step.

Alternatively, the method can be performed using a novel cover and binding assembly including a first cover plate having a spine edge, an inner surface adapted to be placed adjacent one side surface of the stack, and an outer surface, one end portion of the backing being adhered to a portion of the outer surface of the first cover plate adjacent the spine edge of the first cover plate and the backing projecting past the spine edge of the first cover plate, the layer of pressure sensitive adhesive being adhered to the projecting portion of the backing and the assembly including a release liner including a major portion releasably adhered over the layer of pressure sensitive adhesive and a minor portion projecting past the edge of the layer of pressure sensitive adhesive adjacent the first cover plate; and a second cover plate having a spine edge and an inner surface adapted to be placed adjacent a side surface of the stack opposite the first cover plate sheet with the spine edge of the second cover plate aligned with the spine edge of the stack. The method then further includes (4) manually positioning the cover plates on opposite side surfaces of the stack with the spine edges of the cover plates aligned with the spine edges of the sheets during the disposing step; (5) manually positioning the surface of the first cover plate opposite the sheets on a support surface; (6) manually pressing the sheets and cover plates together adjacent the spine edge and against the support surface by pressing on the side of the second cover opposite the sheets while manually pulling the minor portion of the liner upwardly along the spine surfaces to progressively peel the major portion of the liner away from the layer of pressure sensitive adhesive and position the layer of pressure sensitive adhesive smoothly along the spine edges of the sheets to provide the positioning step; and (7) manually adhering an edge portion of the backing opposite the first cover plate to a portion of the second cover plate sheet adjacent the spine edge of the second cover plate between the positioning step and the pressing step.

Both the backing and layer of pressure sensitive adhesive should be sufficiently flexible and low in resilience to intimately conform with the spine edge of the stack under the pressure applied manually to the outer surface of the backing during such application to bind them.

One nonwoven fabric with the desired flexibility and low resiliency when the pleats are formed extending in one direction along the fabric is a 35 grams per square meter (1 ounce per square yard) spun bonded polyamide nonwoven fabric commercially available as Lutrabond #3135 from Lutravil Co., Durham, N.C. The flexibility/stiffness of such a nonwoven fabric when bent in an arc extending in one direction along the fabric can be measured by the INDA (International Nonwoven Disposable Assoc.) Standard Test, "Handle-O-Meter Stiffness" IST 90.0-75 R-82 (a copy of which test is available from INDA, Association of the Nonwoven Fabrics Industry, 1700 Broadway, New York, N.Y. 10019, the content whereof is incorporated herein by reference). That test generally requires having a blade centered over a slot press the test piece of material (which is initially laid across the slot) into the slot while measuring and recording the maximum resistance force the blade encounters in flexing or bending the fabric in an arc extending in one direction along the test piece of material to push it into the slot which force is a measure of both flexibility and surface friction of the nonwoven. The flexibility/stiffness of the Lutrabond #3135 fabric measured by testing a 20.32 centimeter by 20.32 centimeter (8 inches by 8 inches) test sample of the fabric and pressing it into the slot when the slot is adjusted to be 0.635 centimeter (¼ inch) wide is about 60 to 95 grams resistance to flexing when the "cross direction flexibility" of the fabric sample is tested by the blade causing the test sample of that fabric to bend in an arc extending in a first direction along the material that is the machine direction with regard to the way the material is made; and is about 100 to 140 grams resistance to flexing when the "machine direction flexibility" of the fabric sample is tested by the blade causing the test sample of that fabric to bend in an arc extending in a direction at a right angle to the first direction which is the cross machine direction with regard to the way the material is made. Such fabric is suitable for use as the backing for the present invention when the machine direction of the fabric is aligned with the spine edges of the sheets.

Another presently preferred sheet material that can be used as the backing in the present invention is the 35 grams per square centimeter (1 ounce per square yard) 50/50 polyester/cellulose nonwoven fabric available under the trade designation "Confil No. 1310220" from International Paper Company, Lewisburg, Penna., which has a "cross direction flexibility" in the range of 75 to 110 grams when tested by the INDA "Handle-O-Meter Stiffness" Test; the 35 grams per square centimeter (1 ounce per square yard) polypropylene nonwoven fabric available under the trade designation "Celestra" from James River Corporation, Washougal, Wash., which has a "cross direction flexibility" in the range of 50 to 55 grams when tested by the INDA "Handle-O-Meter Stiffness" Test.

Other suitable materials for the backing are the 0.0025 centimeter (0.001 inch) thick ethylene vinyl acetate film available from Consolidated Thermoplastics, Chippewa Falls, Wis., which has a "cross direction flexibility" in the range of 12 to 15 when tested by the INDA "Handle-O-Meter Stiffness" Test; the 0.005 centimeter (0.002 inch) thick 50/50 polyethylene/polypropylene cast film available under the trade designation "RX270" from Consolidated Thermoplastics, Chippewa Falls, Wis., which has a "cross direction flexibility" in the range of 105 to 125 grams when tested by the INDA "Handle-O-Meter Stiffness" Test; and the 0.003 centimeter (0.0012 inch) thick polyethylene film available under the trade designation "TXQ1630" from Consolidated Thermoplastics, Chippewa Falls, Wis., which has a "cross direction flexibility" in the range of 22 to 26 when tested by the INDA "Handle-O-Meter Stiffness" Test.

The maximum flexibility/stiffness of materials determined by the INDA "Handle-O-Meter Stiffness" Test using the test sample size and slot width indicated above that would give acceptable results as the backing in the present invention would appear to be about 200 grams resistance to flexing when the blade causes the test sample of that material to bend in an arc extending in the same direction along the material as the arcs around which the material will have to bend to afford separation of the sheets in the bound stack formed by binding assemblies described above.

Pressure sensitive adhesives that are suitable as the layer of pressure sensitive adhesive in the binding assembly described above should produce an average page pull test value in a stack of pages bound thereby of more than 1.5 pounds per inch of bound length when a book bound by the adhesive is tested in accordance with the page pull test specified in Government Publication Office Publication 310.1, Section F-5.2 (a copy of which can be obtained from the United States Government Printing Office, Washington, D.C., the content whereof is incorporate herein by reference), which page pull test generally comprises opening a book bound using the binding assembly, and pulling one sheet vertically from the opened book while measuring the force required to remove the sheet.

Pressure sensitive adhesives that are suitable as the layer of pressure sensitive adhesive in the binding assembly described above should also cause a book bound by the binding assembly to survive an average of at least 25 or more page flex cycles when the book is tested in accordance with the page flex test specified in Government Publication Office Publication 310.1, Section F-5.3 (a copy of which can be obtained from the United States Government Printing Office, Washington, D.C., the content whereof is incorporate herein by reference), which page flex test generally comprises opening a book using the adhesive on a vertical surface, holding each side of the opened book firmly in place, and flexing a single sheet back and forth while pulling upwardly on the sheet with a force of 2.5 pounds until failure occurs as separation of the sheet from the book or until a predetermined number of flexures is achieved.

Relatively heavy coatings of pressure sensitive adhesive are used in the binding assembly according to the present invention to insure adhesion to each page in the stack. Pressure sensitive adhesives that are suitable as the layer of pressure sensitive adhesive in the binding system described above when applied at a coating weight of over about 15 grains per 24 square inches and preferably at over about 30 grains per 24 square inches include a preferred pressure sensitive adhesive which is easy to apply and after application can exceed the requirements for the tests set forth above that is an acrylic-macromer pressure sensitive adhesive consisting of 100 parts by weight of a polymer consisting of 92 percent by weight of isooctyl acrylate, 4 percent by weight of acrylamide and 4 percent by weight of polystyrene macromer described in U.S. Pat. No. 4,554,324 (the content whereof is incorporated herein by reference); and 40 parts by weight of a tackifier commercially available as "Foral 85" from Hercules, Inc., Wilmington, Del.

FIG. 14 is a graph illustrating the results of the page pull and page flex tests described above performed on books bound with binding assemblies including various weights of the acrylic-macromer pressure sensitive adhesive described above on the 35 grams per square centimeter 50/50 polyester/cellulose nonwoven fabric backing described above after the adhesive coated backings were used to bind 1 inch thick stacks of fan folded sheets, were pressed into engagement with the spine edges of those sheets by buffing them three times against the edge of a table in the manner described above, and were allowed to age for one day.

Other pressure sensitive adhesives that are suitable as the layer of pressure sensitive adhesive in the binding system and at the coating weights described above include a tackified, cross linked acrylic adhesive described in U.S. Pat. No. 4,418,120 (incorporated herein by reference), which is a copolymer in a 94:6 ratio of isooctylacrylate to acrylic acid, containing a tackifying rosin ester and an antioxidant; and tackified block copolymers typified by tackified block copolymers containing styrene and diene components, and tackified by polymerized pinene resin, and stability with antioxidants and U. V. light inhibitors.

The liner or liners used over the layer of pressure sensitive adhesive should provide sufficient resistance to removal to cause the layer of pressure sensitive adhesive to be smoothly portioned along the spine edges of the sheets when the minor portion of the liner is pulled upwardly along the spine edges of the sheets to progressively peel the major portion of the liner away from the layer of pressure sensitive adhesive; and yet should not provide resistance to removal that is so high that it will deform the backing or cause the liner to tear. Liners that work best in the binding assembly or cover and binding assembly described above have been found inch when tested by peeling those liners away from layers of pressure sensitive adhesive on 1 inch wide by 12 inch long test strips disposed on planer support surfaces, in which tests end portions of the liners are pulled at 90 inches per minute in a direction parallel to the support surface along the lengths of the test strips so that the liners are bent through 180 degree arcs as they are removed from the layers of adhesive; whereas liners that are not preferred have been found to have release values above 60 grams per inch when tested by that test method. A preferred liner for use in the binding assembly or in the cover and binding assembly described above is the liner commercially available from Daubert Coated Products, Inc., Cullman, Ala., under the trade designation 1-60BKG-3025.

While the methods and assemblies described herein are particularly useful when the sheets to be bound are fan folded sheets, they are also usable to bind individual sheets, preferably to produce book that will see minimal usage, since such books have been found to have average page pull test values of about 0.25 pounds per inch of bound length, and to survive an average of only about 3 page flex cycles when the books are tested as described above.

BRIEF DESCRIPTION OF DRAWING

The present invention will, be further described with reference to the accompanying drawing wherein like reference numerals refer to like parts in the several views, and wherein.

DETAILED DESCRIPTION

Figure 11:
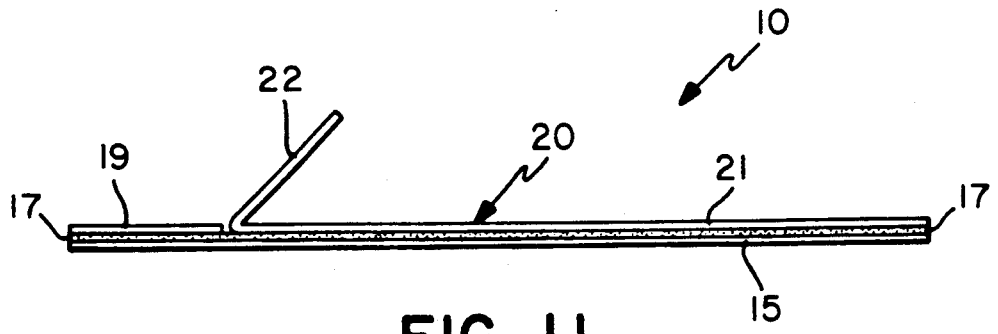
FIG. 11 is an enlarged end view of the binding assembly used to bind the sheets in FIGS. 1 through 5.

Referring now to FIGS. 1 through 5 of the drawing there is illustrated a method for using a novel binding assembly 10 illustrated in FIG. 11 for binding a stack of generally uniformly sized sheets 12 to form a bound book 13.

The binding assembly 10 (FIG. 11) includes a flexible backing 15 having low resiliency, a generally planar uniformly thick layer 17 of pressure sensitive adhesive adhered to one major surface of the backing 15, a narrow release liner 19 (e.g., 60–80 pound per ream silicone coated craft paper) releasably adhered over a narrow strip of the layer 17 of pressure sensitive adhesive adjacent and along one edge of the backing 15, and a large release liner 20 (e.g., 60–80 pound per ream silicone coated craft paper) including a major portion 21 releasably adhered over the portion of the layer 17 of pressure sensitive adhesive not covered by the narrow release liner 19 and a minor portion 22 projecting past the adjacent edge of the narrow release liner 19.

Figure 1:
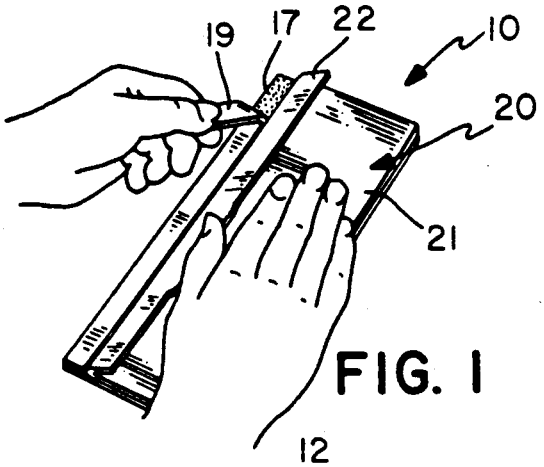
FIGS. 1 through 5 are perspective views sequentially illustrating a method for binding sheets to form a bound book using a binding assembly according to the present invention.
Figure 4:
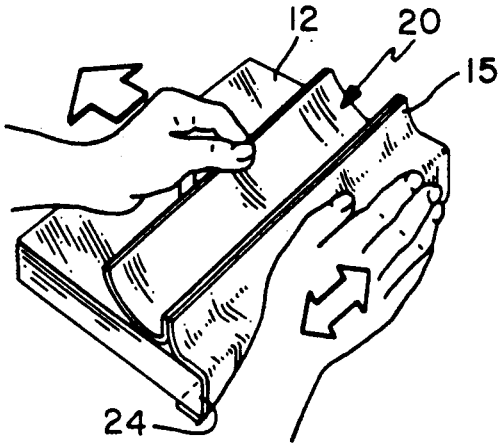
Figure 2:
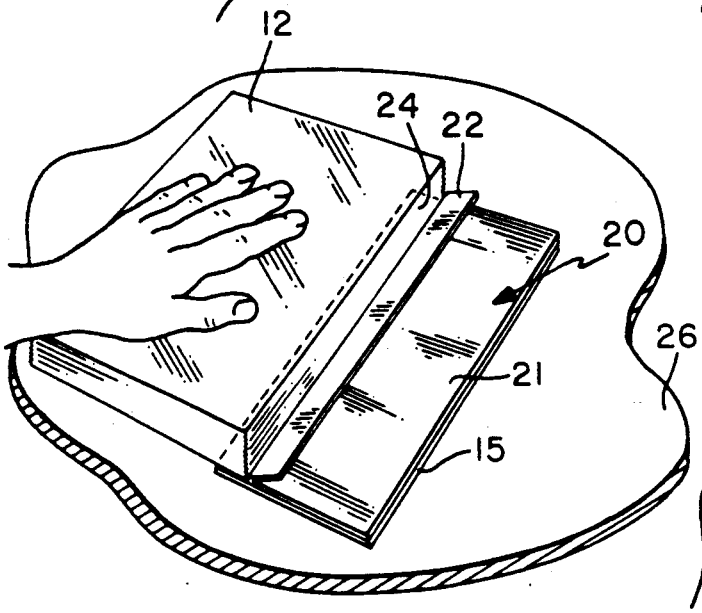
Figure 5:
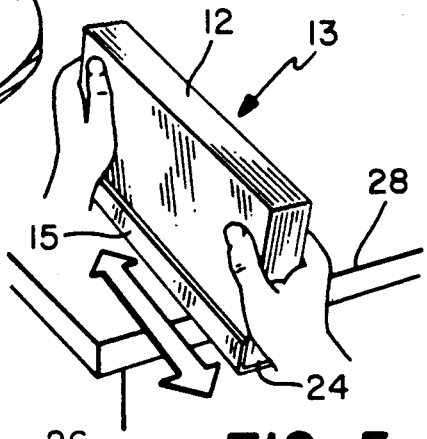
Figure 3:
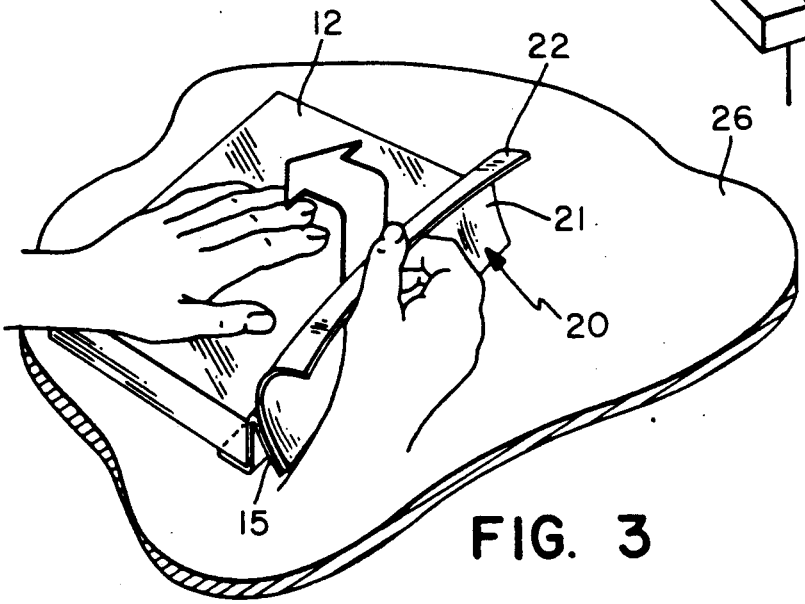

The method illustrated in FIGS. 1 through 5 is particularly useful when the sheets 12 to be bound are fan folded sheets, and includes the steps of (1) disposing the stack of sheets 12 in a position with spine edges 24 of the sheets 12 generally aligned in a plane generally at a right angle to the side surfaces of sheets 12 as is illustrated in FIG. 2, (2) removing the narrow release liner 19 as is illustrated in FIG. 1 and adhering the exposed narrow portion of the layer 17 of pressure sensitive adhesive to a portion of the outer surface of one outermost sheet 12 in the stack adjacent its spine edge 24 with the backing 15 projecting past its spine edge 24 as is illustrated in FIG. 2; (3) positioning the side opposite the stack of the sheet 12 to which the backing 15 is adhered on a support surface 26 as is illustrated in FIGS. 2 and 3; (4) manually pressing the sheets 12 together adjacent the spine edge 24 and against the support surface 26 by pressing on the side of the stack opposite the sheet 12 to which the backing 15 is adhered while manually pulling the minor portion 22 of the large release liner 20 upwardly along the aligned spine edges 24 of the sheets 12 to progressively peel the large liner 20 away from the layer 17 of pressure sensitive adhesive and position the layer 17 of pressure sensitive adhesive smoothly along and over the spine edges 24 of the sheets 12; (5) manually adhering an edge portion of the backing 15 opposite the sheet 12 to which the backing 12 was initially adhered to a portion of the sheet 12 on the opposite side of the stack; and (6) manually pressing the backing 15 against the spine edges 24 of the sheets 12 to cause conformation of the backing 15 and adhesion of the layer 17 of pressure sensitive adhesive to the spine edges 24 of the sheets 12, which pressing could be done by manually rubbing a squeegee along the side of the backing 15 opposite the spine edges 24, but preferably is done as is illustrated in FIG. 5 by manually pressing the spine edges 24 of the sheets 12 toward an edge 28 of a structure such as a table or desk with the edge 28 disposed transverse of the spine edges 24 of the sheets 12 on the surface of the backing 15 opposite the layer 17 of adhesive while moving the spine edges 24 longitudinally to bring the majority of the side of the backing 15 opposite the layer 17 of pressure sensitive adhesive progressively into engagement with the edge 28 so that a large localized pressure is applied to insure that the backing 15 conforms to the contour of the spine edges 24 and the layer 17 of adhesive adheres to each of those spine edges 24.

Figure 12:
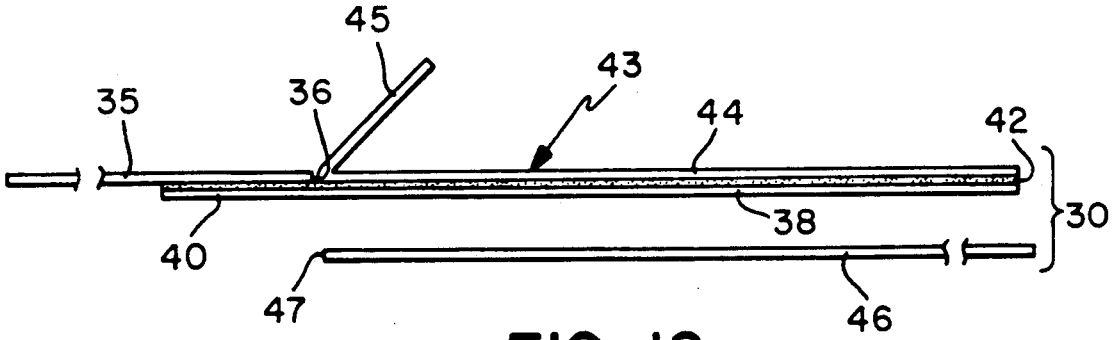
FIG. 12 is an enlarged end view of the cover and binding assembly used to bind the sheets in FIGS. 6 through 10.

Referring now to FIGS. 6 through 10 of the drawing there is illustrated a method for using a novel cover and binding assembly 30 illustrated in FIG. 12 for binding a stack of generally uniformly sized sheets 32 to form a bound book 33.

The cover and binding assembly 30 (FIG. 12) includes a first cover plate 35 having a spine edge 36, an inner surface adapted to be placed adjacent one side surface of the stack, and an outer surface; a flexible backing 38 having low resilience, one end portion 40 of the backing 38 being adhered to a portion of the outer surface of the first cover plate 35 adjacent the spine edge 36 of the first cover plate 35 and the backing 38 projecting past the spine edge 36 of the first cover plate 35, a generally planar uniformly thick layer 42 of pressure sensitive adhesive adhered to one major surface of the projecting portion of the backing 38, a release liner 43 (e.g., 60–80 pound per ream silicone coated craft paper) including a major portion 44 releasably adhered over the layer 42 of pressure sensitive adhesive and a minor portion 45 projecting past the edge of the layer 42 of pressure sensitive adhesive adjacent the first cover plate 35; and a second cover plate 46 having a spine edge 47 and an inner surface adapted to be placed adjacent a side surface of the stack of sheets 32 opposite the first cover plate 35 with the spine edge 47 of the second cover plate 46 aligned with the spine edges of the sheets 32 in the stack.

Figure 6:
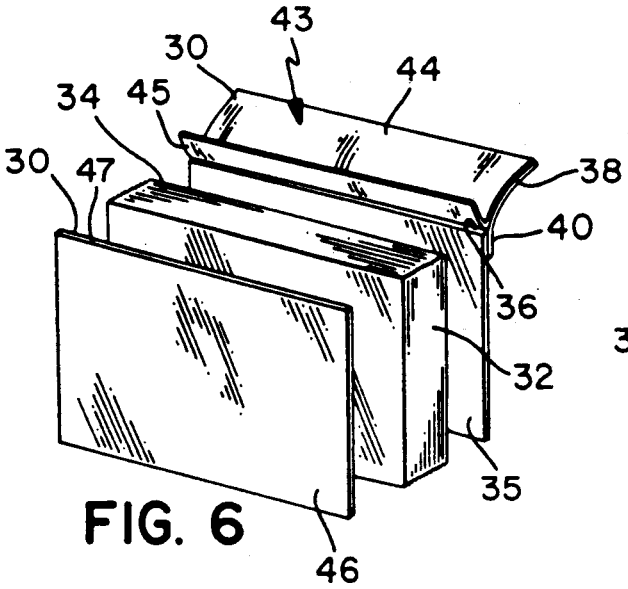
FIGS. 6 through 10 are perspective views sequentially illustrating a method for binding sheets to form a bound book using a cover and binding assembly according to the present invention.
Figure 9:
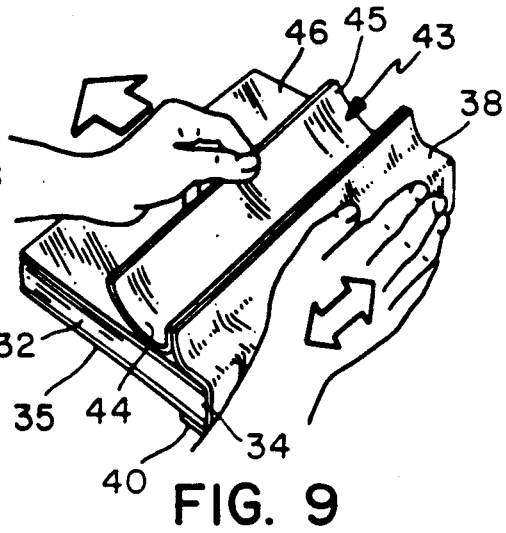
Figure 7:
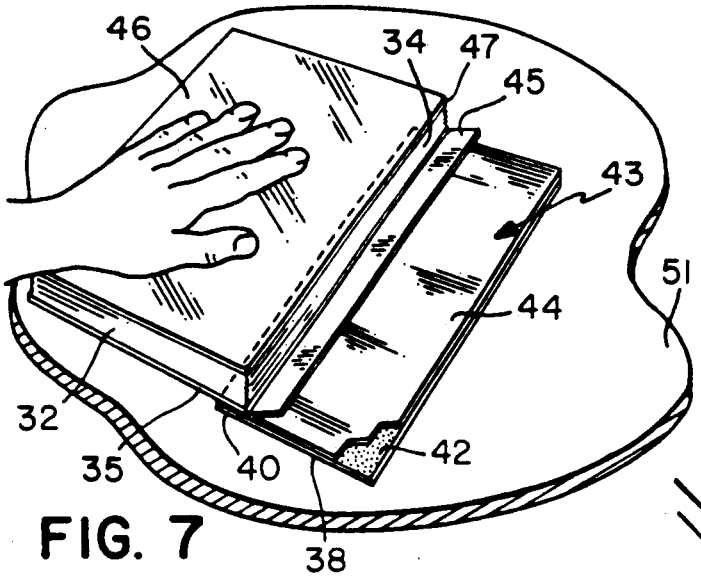
Figure 10:
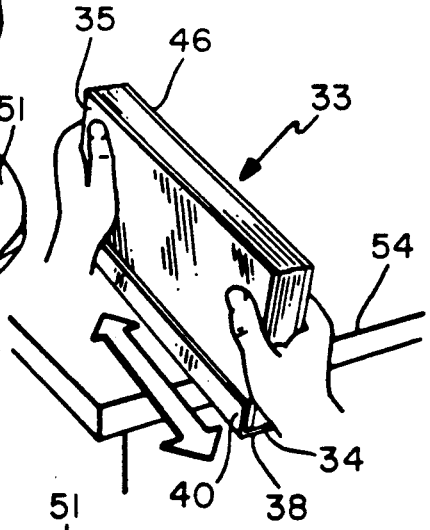
Figure 8:
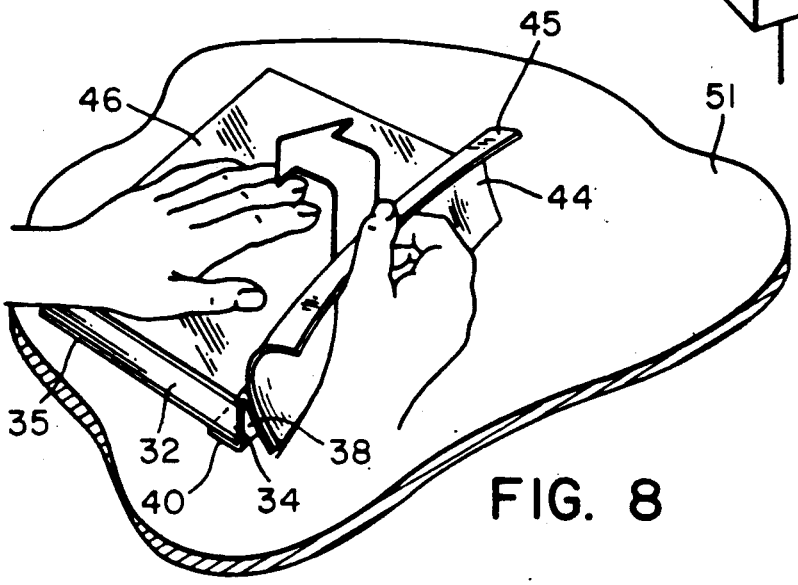

The method illustrated in FIGS. 6 through 10 is also particularly useful when the sheets 32 to be bound are fan folded sheets, and includes the steps of (1) disposing the stack of sheets 32 in a position with spine edges 34 of the sheets 12 generally aligned in a plane generally at a right angle to the side surfaces of sheets 32 as is illustrated in FIG. 6, (2) manually positioning the cover plates 35 and 46 on opposite side surfaces of the stack with the spine edges 36 and 47 of the cover plates 35 and 46 aligned with the spine edges 34 of the sheets 32 during the disposing step; (3) manually positioning the surface of the first cover plate 35 opposite the sheets 32 on a support surface 51; (4) manually pressing the sheets 32 and cover plates 35 and 46 together adjacent the spine edges 36, 47 and 34 and against the support surface 51 by pressing on the side of the second cover plate 46 opposite the sheets 32 while manually pulling the minor portion 45 of the liner 43 upwardly along the spine edges 36, 34, 47 to progressively peel the liner 43 away from the layer 42 of pressure sensitive adhesive and position the layer 42 of pressure sensitive adhesive smoothly along the spine edges 34 of the sheets 32; (5) manually adhering an edge portion of the backing 38 opposite the first cover plate 35 to a portion of the second cover plate 46 adjacent the spine edge 47 of the second cover plate 46; and (6) manually pressing the backing 38 against the spine edges 34 of the sheets 32 to cause conformation of the backing 38 and adhesion of the layer 42 of pressure sensitive adhesive to the spine edges 34 of the sheets 32, which pressing could be done by manually rubbing a squeegee along the side of the backing 38 opposite the spine edges 34 of the sheets 32, but preferably is done as is illustrated in FIG. 10 by manually pressing the spine edges 34 of the sheets 32 toward an edge 54 of a structure such as a table or desk with the edge 54 disposed transverse of the spine edges 34 of the sheets 32 on the surface of the backing 38 opposite the layer 42 of pressure sensitive adhesive while moving the spine edges 34 longitudinally to bring the majority of the side of the backing 38 opposite the layer 42 of pressure sensitive adhesive progressively into engagement with the edge 54 so that a large localized pressure is applied to insure that the backing 38 conforms to the contour of the spine edges 34 and the layer 42 of adhesive adheres to each of those spine edges 34.

The cover plates 35 and 46 are of a stiff flexible material (e.g., 0.038 centimeter (0.015 inch) thick coated and embossed cover stock available under the trade designation "Norval" cover stock from Boise Cascade, Brattebo, Vt. or about 0.025 to 0.064 centimeter (0.010 to 0.025 inch) thick cover stock material), and while having about the same major surface dimensions as the sheets 32 to be bound, are preferably about 0.0127 centimeter (0.005 inch) shorter between their spine edges 36 and 47 and their opposite outer edges than sheets 32 in the stack to insure that the layer 42 of pressure sensitive adhesive will contact the spine edges 34 of the sheets 32 adjacent them when the cover and binding assembly 30 is applied to a stack of sheets 32 in the manner described above.

Figure 13:
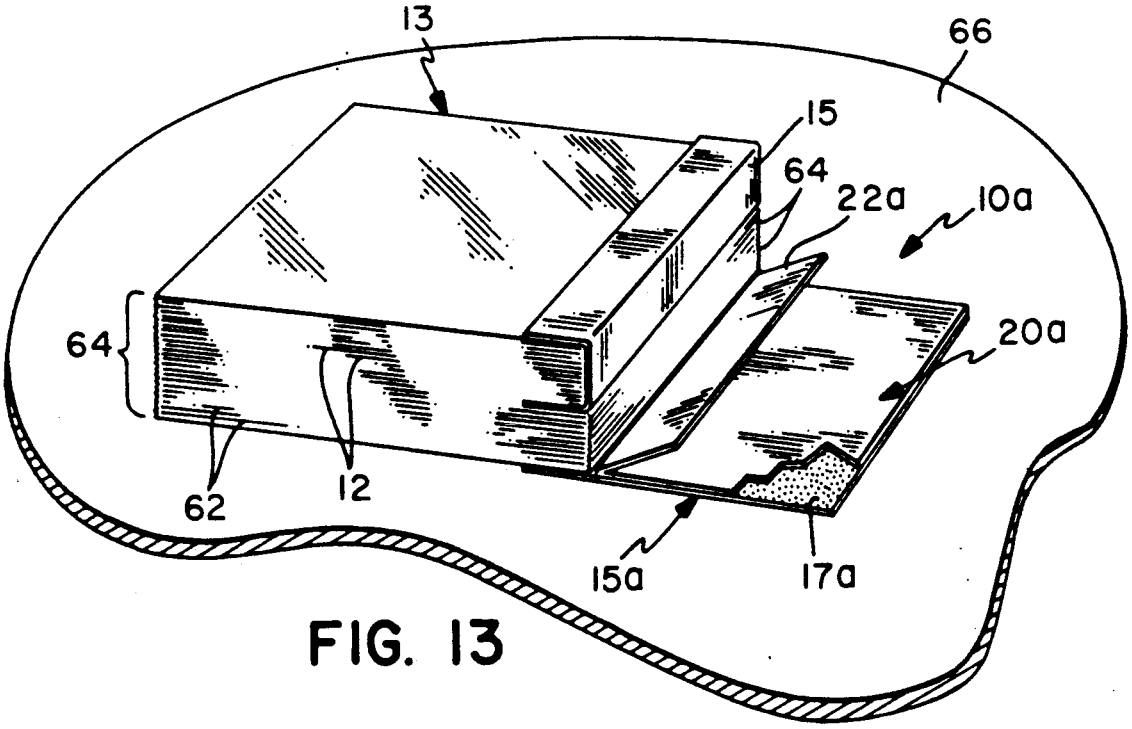
FIG. 13 is a perspective view of an already bound book being bound to an additional stack of sheets using the binding assembly illustrated in FIG. 11.
Figure 14:
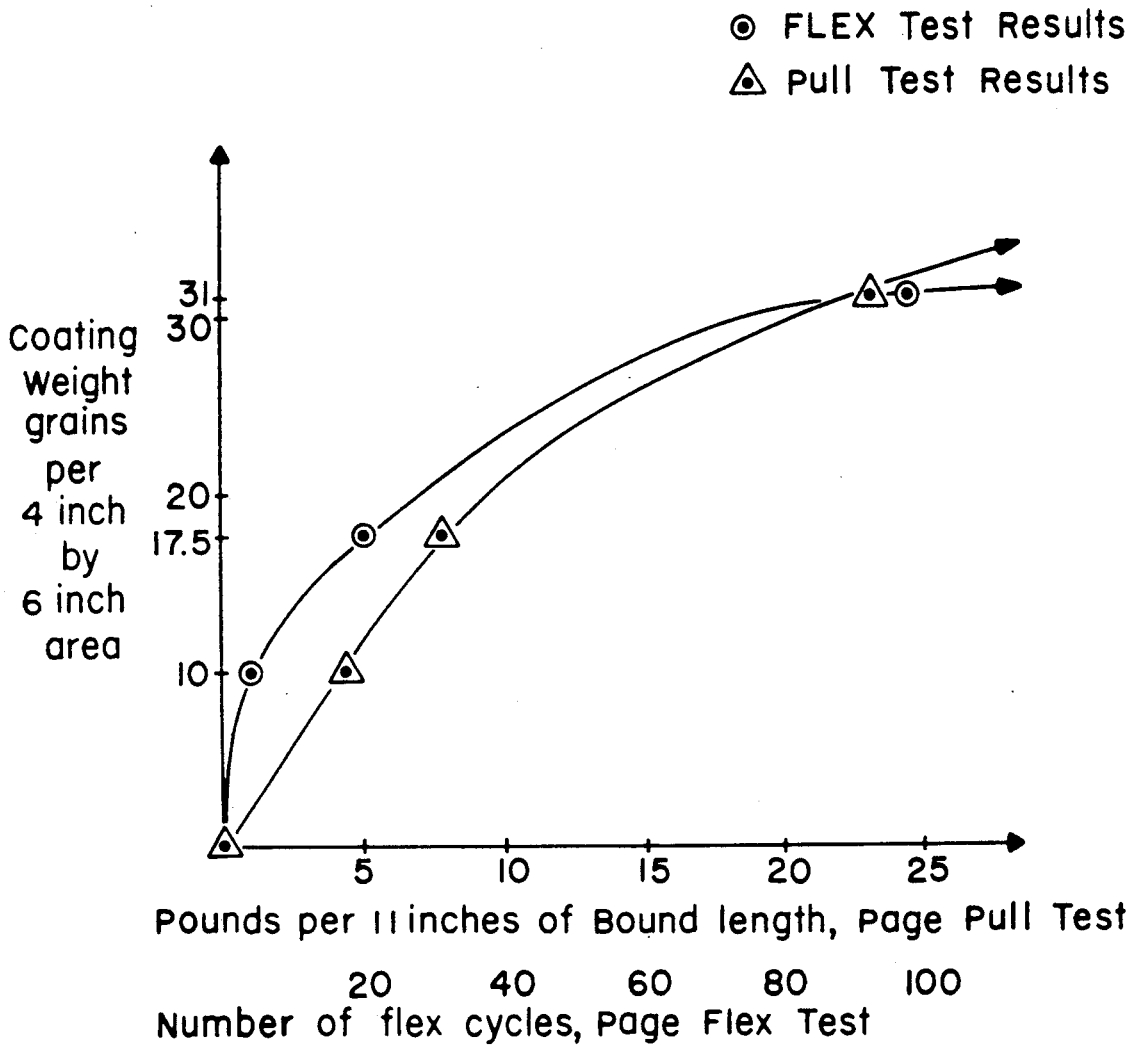
FIG. 14 is a graph of test results using a binding assembly according to the present invention.

Referring now to FIG. 13 of the drawing there is illustrated a method for using a binding assembly **10*a* to bind a second stack of generally uniformly sized fan folded sheets 62 to the book 13 bound as illustrated and described with reference to FIGS. 1–5 and 11 to form a larger book 64, as may be desirable, for example, to bind a report from one month to a report from a previous month that has already been bound using the binding assembly 10. The binding assembly 10*a* has exactly the same structure as the binding assembly 10, and in FIG. 13** the parts thereof have been identified using the same reference numerals to which have been added the suffix "a".

The method illustrated in FIG. 13 is similar to the method illustrated in FIGS. 1–5, and explained above with reference thereto, and includes the steps of (1) disposing the stack of sheets 62 on one side of the book 13 in a position with spine edges 64 of the sheets 62 generally aligned in a plane generally at a right angle to the side surfaces of the sheets 62 and to the outer surface of a portion of the backing 15 along the spine edges of the sheets 12 in the book 13, (2) removing the narrow release liner 19*a* (not shown) and adhering the exposed narrow portion of the layer 17*a* of pressure sensitive adhesive to a portion of the outer surface of the outer sheet 62 in the stack adjacent its spine edge 64 with the backing 15*a* projecting past its spine edge 64 as is illustrated in FIG. 13; (3) positioning the side opposite the book 13 of the sheet 62 to which the backing 15*a* is adhered on a support surface 66 as is illustrated in FIG. 13; (4) manually pressing the sheets 62 and book 13 together adjacent the spine edges 64 and against the support surface 66 by pressing on the book 13 while manually pulling the minor portion 22*a* of the large release liner 20*a* upwardly along the aligned spine edges 64 of the sheets 62 and along the outer surface of the portion of the backing 15 along the spine edges of the sheets 12 in the book 13 (not illustrated) to progressively peel the large liner 20*a* away from the layer 17*a* of pressure sensitive adhesive and position the layer 17*a* of pressure sensitive adhesive smoothly along and over the spine edges 64 of the sheets 62 and that portion of the backing 15; (5) manually adhering an edge portion of the backing 15*a* opposite the sheet 62 to which the backing 12*a* was initially adhered to a portion of the book 13 on its side opposite the sheets 62 (not illustrated); and (6) manually pressing the backing 15*a* against the spine edges 64 of the sheets 62 to cause conformation of the backing 15*a* and adhesion of the layer 17*a* of pressure sensitive adhesive to the spine edges 64 of the sheets 62, which pressing could be done by manually rubbing a squeegee along the side of the backing 15*a* opposite the spine edges 64, but preferably is done as is illustrated in FIG. 5 for the book 13 by manually pressing the spine edges 64 of the sheets 62 toward an edge of a structure such as a table or desk with the edge disposed transverse of the spine edges 64 of the sheets 62 on the surface of the backing 15*a* opposite the layer 17*a* of adhesive while moving the spine edges 64 longitudinally to bring the majority of the side of the backing 15*a* opposite the layer 17*a* of pressure sensitive adhesive progressively into engagement with the edge so that a large localized pressure is applied to insure that the backing 15*a* conforms to the contour of the spine edges 64 and the layer 17*a* of adhesive adheres to each of those spine edges 64.

Alternatively, the binding assembly 10 could be used to bind a second stack of sheets to the book 33 formed as described with reference to FIGS. 6 through 10 in a manner similar to that described above; or the cover and binding assembly 30 illustrated in FIG. 12 could be used to bind a second stack of sheets to either a book 13 formed as described with reference to FIGS. 1 through 5 or the book 33 described with reference to FIGS. 6 through 10 in a manner similar to that described above.

The present invention has now been described with reference to several embodiments thereof. It will be apparent to those skilled in the art that many changes can be made in the embodiments described without departing from the scope of the present invention. Thus the scope of the present invention should not be limited to the structures and methods described in this application, but only by structures and methods described by the language of the claims and the equivalents of those structures and methods.

We claim:

1. A method adapted for binding a stack of generally uniformly sized sheets, said sheets each having a spine edge, an outer edge opposite said spine edge, and opposite major side surfaces, each of said sheets, except for the outermost sheets in the stack which are each joined only along one of said edges, being joined at both of said edges to sheets adjacent its major surfaces in the stack with the spine edges of the sheet being joined to the spine edge of the sheet along one of said side surfaces, and the outer edge of the sheet being joined to the outer edge of the sheet along the other of said side surfaces, said method comprising the steps of:

manually disposing the stack of sheets with the spine edges of the sheets generally aligned in a plane generally at a right angle to the side surfaces of the sheets int he stack;

manually positioning a thick layer of pressure sensitive adhesive already adhered to a generally planar portion of a highly flexible backing having low resiliency over the spine edges;

manually pressing the side of the backing against the spine edges of the sheets to cause conformation of the backing and adhesion of the layer of pressure sensitive adhesive to the spine edges of the sheets;

providing a second stack of the sheets;

disposing the second stack of sheets on one side of the book formed by the manually disposing, manually positioning and manually pressing steps in a position with spine edges of the sheets generally aligned ion a plane generally at a right angle to the side surfaces of the sheets and to the outer surface of a portion of the backing along the spine edges of the sheets in the book;

manually positioning a thick layer of pressure sensitive adhesive already adhered to a generally planar portion of a highly flexible backing having low resiliency over the spine edges of the second stack of sheets and said portion of the backing along the spine edges of the sheets in the book; and manually pressing the side of the backing against the spine edges of the sheets to and said portion of the backing along the spine edges of the sheets in the book to cause conformation of the backing and adhesion of the layer of pressure sensitive adhesive to the spine edges of the second stack of sheets.

2. A method adapted for binding a stack of generally uniformly sized sheets to form a book, said sheets each having a spine edge, an outer edge opposite said spine edge, and opposite major side surfaces, each of said sheets, except for the outermost sheets int he stack which are each joined only along one of said edges, being joined at both of said edges to sheets adjacent its major surfaces i the stack with the spine edges of the sheet being joined to the spine edge of the sheet along one of said side surfaces, and the outer edge of the sheet being joined to the outer edge of the sheet along the other of said side surfaces, said method comprising the steps of:

providing a binding assembly including a highly flexible backing having low resiliency, a thick layer of pressure sensitive adhesive adhered to a generally planar portion of the backing, a narrow release liner releasably adhered over a narrow strip of the pressure sensitive adhesive adjacent and along one edge of the backing, and a large release liner including a major portion releasably adhered over the portion of the layer of pressure sensitive adhesive not covered by the narrow release liner and a minor portion projecting past the adjacent edge of the narrow release liner;

manually disposing the stack of sheets with the spine edges of the sheets generally aligned in a plane generally at a right angle to the side surfaces of the sheets in the stack;

removing the narrow release liner;

adhering the exposed narrow portion of the pressure sensitive adhesive to a portion of the outer surface of one outermost sheet in the stack adjacent its spine edge with the backing projecting past its spine edge;

positioning the side opposite the stack of the sheet to which the backing is adhered on a support surface;

manually pressing the sheets together adjacent their spine edges and against the support surface by pressing on the side of the stack opposite the sheet to which the backing is adhered while manually pulling the minor portion of the large release liner upwardly along the spine edges of the sheets o progressively peel the large liner away from the layer of pressure sensitive adhesive and position the layer of pressure sensitive adhesive smoothly along the spine edges of the sheets manually pressing the side of the backing against the spine edges of the sheets to cause conformation of the backing and adhesion of the layer of pressure sensitive adhesive to the spine edges of the sheets; and manually adhering an edge portion of the backing opposite the sheet to which the backing was adhered in said adhering step to a portion of the sheet on the opposite side of the stack between said positioning step and said step of manually pressing the side of the backing against the spine edges of the sheets.

3. A method according to claim 2 wherein said step of manually pressing the side of the backing against the spine edge of the sheets to cause conformation of the backing and adhesion of the layer of pressure sensitive adhesive to the spine edges of the sheets comprises the step of manually pressing the spine edges of the sheets toward an edge of a structure such as a table or desk with the edge disposed transverse of the spine edges of the sheets along the surface of the backing opposite the layer of pressure sensitive adhesive while moving the spine edges longitudinally to bring the majority of the side of the backing opposite the layer of pressure sensitive adhesive progressively into engagement with the edge.

4. A binding assembly adapted for use to bind a stack of generally uniformly sized sheets each having a spine edge, an outer edge opposite said spine edge, and opposite major side surfaces, each of said sheets except for the outermost sheets in the stack which are each joined only along one of said edges, being joined at both of said edges to sheets adjacent its major surfaces int eh stack with the spine edges of the sheet being joined to the spine edge of the sheet along one of said side surfaces, and the outer edge of the sheet being joined to the outer edge of the sheet along the other of said side surfaces, the stack of sheets being disposed with the spine edges of the sheets generally aligned in a plane generally at a right angle tot he side surfaces of the sheets int he stack and having opposite side surfaces, said binding assembly comprising:

a strong highly flexible backing having low resilience, said backing being a sheet material having a flexibility/stiffness of less than about 200 grams resistance to flexing when measured in accordance with the International Nonwoven Disposable Association Handle-O-Meter Stiffness Standard Test, IST 90.0-75 R-82, using a test sample of said sheet material 20.32 centimeter by 20.32 centimeter and having a slot into which said test sample of sheet material is pressed adjusted to be 0.635 centimeter wide and said test sample of sheet material is caused by the test to bend in an arc extending int the same direction along the test sample of material as the arcs around which the sheet material will have to bend to afford separation of the sheets in the bound stack; and a layer of pressure sensitive adhesive at a coating weight of over about 15 grains per 24 square inches adhered to the backing.

5. A binding assembly according to claim 4 further including a narrow release liner releasably adhered over a narrow strip of the pressure sensitive adhesive adjacent and along one edge of the backing; and a large release liner including a major portion releasably adhered over the portion of the layer of pressure sensitive adhesive not covered by the narrow release liner and a minor portion projecting past the adjacent edge of the narrow release liner;

said binding assembly being usable to bind the stack by removing the narrow release liner and adhering the exposed narrow portion of the pressure sensitive adhesive to a portion of the side surface of the stack adjacent the spine edges of the sheets with the backing projecting past the spine edges, positioning the side surface of the stack to which the backing is adhered on a support surface, manually pressing the sheets together adjacent the spine edges and against the support surface by pressing on the side of the stack opposite the side to which the backing is adhered while manually pulling the minor portion of the large release liner upwardly along the spine surfaces to progressively peel the major portion of the large liner away from the layer of pressure sensitive adhesive and smoothly position the layer of pressure sensitive adhesive along the spine edges of the sheets, manually adhering an edge portion of the backing opposite the side of the stack which the backing was adhered to a portion of the opposite side of the stack, and manually firmly pressing the side of the backing against the spine edge of the sheets to cause conformation of the backing and firm adhesion of the layer of pressure sensitive adhesive to the spine edges of the sheets.

6. A binding assembly according to claim 4, wherein said backing is a nonwoven fabric having a flexibility/-stiffness in the range of about 50 to 110 grams resistance to flexing when measured in accordance with the International Nonwoven Disposable Association Handle-O-Meter Stiffness Standard Test, IST 90.0-75 R-82 using a test sample of said nonwoven fabric 20.32 centimeter by 20.32 centimeter and having a slot into which said test sample of nonwoven fabric is pressed adjusted to be 0.635 centimeter wide and said test sample of nonwoven fabric is caused by the test to bend in an arc extending in the same direction along the test sample of fabric as the arcs around which the nonwoven fabric will have to bend to afford separation of the sheets in the bound stack.

7. A binding assembly according to claim 4, wherein said backing is a polymeric film having a flexibility/-stiffness in the range of about 12 to 125 grams resistance to flexing when measured in accordance with the International Nonwoven Disposable Association Handle-O-Meter Stiffness Standard Test, IST 90.0-75 R-82 using a test sample of said film 20.32 centimeter by 20.32 centimeter and having a slot into which said test sample of film is pressed adjusted to be 0.635 centimeter wide and said test sample of film is caused by the test to bend in an arc extending in the same direction along the test sample of film as the arcs around which the film will have to bend to afford separation of the sheets in the bound stack.

8. A binding assembly according to claim 4 wherein said layer of pressure sensitive adhesive is an acrylic-macromer pressure sensitive adhesive at a coating weight of over about 30 grains per 24 square inches consisting of 100 parts by weight of a polymer consisting of 92 percent by weight of isooctyl acrylate, 4 percent by weight of acrylamide and 4 percent by weight of polystyrene macromer; and 40 parts by weight of a tackifier.

9. A cover and binding assembly adapted for use to bind a stack of generally uniformly sized sheets each having a spine edge, an outer edge opposite said spine edge, and opposite major side surfaces, each of said sheets except for the outermost sheets in the stack which are each joined only along one of said edges, being joined at both of said edges to sheets adjacent its major surfaces in the stack with the spine edges of the sheet being joined to the spine edge of the sheet along one of said side surfaces, and the outer edge of the sheet being joined to the outer edge of the sheet along the other of said side surfaces, the stack of sheets being disposed with the spine edges of the sheets generally aligned in a plane generally at a right angle to the side surfaces of the sheets in the stack and having opposite side surfaces, said cover and binding assembly comprising a first cover assembly including a first cover plate having a spine edge, an inner surface adapted to be placed adjacent one side surface of the stack, and an outer surface, a strong highly flexible backing having low resilience, said backing being a sheet material having a flexibility/stiffness of less than about 200 grams resistance to flexing when measured in accordance with the International Nonwoven Disposable Association Handle-O-Meter Stiffness Standard Test, IST 90.0-75 R-82, using a test sample of said sheet material 20.32 centimeter by 20.32 centimeter and having a slot into which said test sample of sheet material is pressed adjusted to be 0.635 centimeter wide and said test sample of sheet material is caused by the test to bend in an arc extending in the same direction along the test sample of material as the arcs around which the sheet material will have to bend to afford separation of the sheets in the bound stack, one end portion of the backing being adhered to a portion of the outer surface of the first cover plate adjacent the spine edge of the first cover plate and the backing projecting past the spine edge of the first cover plate, and a layer of pressure sensitive adhesive at a coating weight of over about 15 grains per 24 square inches adhered to the projecting portion of the backing.

10. A cover and binding assembly according to claim 9 further including a release liner including a major portion releasably adhered over the layer of pressure sensitive adhesive and a minor portion projecting past the edge of the layer of pressure sensitive adhesive adjacent the first cover plate; and a second cover plate having a spine edge and an inner surface adapted to be placed adjacent a side surface of the stack opposite the first cover plate sheet with the spine edge of the second cover plate aligned with the spine edge of the stack, said cover and binding assembly being usable to bind the stack by manually positioning the cover plates on opposite side surfaces of the stack with the spine edges of the cover plates aligned with the spine edges of the sheets, manually positioning the surface of the first cover plate opposite the sheets on a support surface, manually pressing the sheets and cover plates together adjacent the spine edge and against the support surface by pressing on the side of the second cover opposite the sheets while manually pulling the minor portion of the liner upwardly along the spine surfaces to progressively peel the liner away from the layer of pressure sensitive adhesive and position the layer of pressure sensitive adhesive smoothly along the spine edges of the sheets, manually adhering an edge portion of the backing opposite the first cover plate to a portion of the second cover plate adjacent the spine edge of the second cover plate, and manually firmly pressing the side of the backing against the spine edge of the sheets to cause conformation of the backing and firm adhesion of the layer of pressure sensitive adhesive to the spine edges of the sheets.

11. A cover and binding assembly according to claim 9, wherein said backing is a nonwoven fabric having a flexibility/stiffness in the range of about 50 to 110 grams resistance to flexing when measured in accordance with the International Nonwoven Disposable Association Handle-O-Meter Stiffness Standard Test, IST 90.0-75 R-82 using a test sample of said nonwoven fabric 20.32 centimeter by 20.32 centimeter and having a slot into which said test sample of nonwoven fabric is pressed adjusted to be 0.635 centimeter wide and said test sample of nonwoven fabric is caused by the test to bend in an ar extending in the same direction along the test sample of fabric as the arcs around which the nonwoven fabric will have to bend to afford separation of the sheets in the bound stack.

12. A cover and binding assembly according to claim 9, wherein said backing is a polymeric film having a flexibility/stiffness in the range of about 12 to 125 grams resistance to flexing when measured in accordance with the International Nonwoven Disposable Association Handle-O-Meter Stiffness Standard Test, IST 90.0-75 R-82 using a test sample of said film 20.32 centimeter by 20.32 centimeter and having a slot into which said test sample of film is pressed adjusted to be 0.635 centimeter wide and said test sample of film is caused by the test to bend in an arc extending in the same direction along the test sample of film as the arcs around which the film will have to bend to afford separation of the sheets in the bound stack.

13. A cover and binding assembly according to claim 9 wherein said layer of pressure sensitive adhesive is an acrylic-macromer pressure sensitive adhesive at a coating weight of over about 30 grains per 24 square inches consisting of 100 parts by weight of a polymer consisting of 92 percent by weight of isooctyl acrylate, 4 percent by weight of acrylamide and 4 percent by weight of polystyrene macromer; and 40 parts by weight of a tackifier.

14. A bound book comprising:

a multiplicity of similarly sized sheets each having a spine edge, an outer edge opposite said spine edge, and opposite major side surfaces, said sheets being disposed in a stack having opposite sides with the spine edges of said sheets aligned to define a generally planar surface at generally a right angle to said opposite sides, each of said sheets, except for the outermost sheets in the stack which are each joined along only one of said edges, being joined at both of said edges to sheets adjacent its major side surfaces with the spine edges of the sheet being joined to the spine edge of the sheet along one of said side surfaces, and the outer edge of the sheet being joined to the outer edge of the sheet along the other of said side surfaces;

a highly flexible strong backing having low resilience, said backing being a sheet material having a flexibility/stiffness of less than about 200 grams resistance to flexing when measured in accordance with the International Nonwoven Disposable Association Handle-O-Meter Stiffness Standard Test, IST 90.0-75 R-82, using a test sample of said sheet material 20.32 centimeter by 20.32 centimeter and having a slot into which said test sample of sheet material is pressed adjusted to be 0.635 centimeter wide and said test sample of sheet material is caused by the test to bend in an arc extending in the same direction along the test sample of material as the arcs around which the sheet material will have to bend to afford separation of the sheets in the bound book; and a layer of pressure sensitive adhesive adhered to said backing at a coating weight of over about 15 grains per 24 square inches, which layer of pressure sensitive adhesive has been adhered across the aligned spine edges of said sheets;

said layer of pressure sensitive adhesive and said flexible backing conforming closely to the spine edges of the sheets; and said backing having end portions adhered to portions of the end sheets in said stack adjacent said spine edges.

15. A bound book according to claim 14, wherein said backing is a nonwoven fabric having a flexibility/stiffness in the range of about 50 to 110 grams resistance to flexing when measured in accordance with the International Nonwoven Disposable Association Handle-O-Meter Stiffness Standard Test, IST 90.0-75 R-82 using a test sample of said nonwoven fabric 20.32 centimeter by 20.32 centimeter and having a slot into which said test sample of nonwoven fabric is pressed adjusted to be 0.635 centimeter wide and said test sample of nonwoven fabric is caused by the test to bend in an arc extending in the same direction along the test sample of fabric as the arcs around which the nonwoven fabric will have to bend to afford separation of the sheets in the bound stack.

16. A bound book according to claim 14, wherein said backing is a polymeric film having a flexibility/stiffness in the range of about 12 to 125 grams resistance to flexing when measured in accordance with the International Nonwoven Disposable Association Handle-O-Meter Stiffness Standard Test, IST 90.0-75 R-82 using a test sample of said film 20.32 centimeter by 20.32 centimeter and having a slot into which said test sample of film is pressed adjusted to be 0.635 centimeter wide and said test sample of film is caused by the test to bend in an arc extending in the same direction along the test sample of film as the arcs around which the film will have to bend to afford separation of the sheets in the bound stack.

17. A bound book according to claim 14 wherein said layer of pressure sensitive adhesive is an acrylic-macromer pressure sensitive adhesive at a coating weight of over about 30 grains per 24 square inches consisting of 100 parts by weight of a polymer consisting of 92 percent by weight of isooctyl acrylate, 4 percent by weight of acrylamide and 4 percent by weight of polystyrene macromer; and 40 parts by weight of a tackifier.

18. A bound book according to claim 14 wherein said book comprises a second stack of similarly sized sheets each having a spine edge;

a second highly flexible strong backing having low resilience, said backing being a sheet material having a flexibility/stiffness of less than about 200 grams resistance to flexing when measured in accordance with the International Nonwoven Disposable Association Handle-O-Meter Stiffness Standard Test, IST 90.0-75 R-82, using a test sample of said sheet material 20.32 centimeter by 20.32 centimeter and having a slot into which said test sample of sheet material is pressed adjusted to be 0.635 centimeter wide and said test sample of sheet material is caused by the test to bend in an arc extending in the same direction along the test sample of material as the arcs around which the sheet material will have to bend to afford separation of the sheets in the bound book; and a second layer of pressure sensitive adhesive adhered to said backing at a coating weight of over about 15 grains per 24 square inches, which layer of pressure sensitive adhesive has been adhered across the aligned spine edges of said second stack of sheets and a portion of the backing over the spine edges of the sheets in the first stack of sheets;

said layer of pressure sensitive adhesive and said flexible backing conforming closely to the spine edges of the sheets in the second stack; and said second backing having a first end portion adhered to a portion of the end sheets in said second stack adjacent said spine edges.

19. A bound book comprising:

a multiplicity of similarly sized sheets each having a spine edge, an outer edge opposite said spine edge, and opposite major side surfaces, said sheets being disposed in a stack having opposite sides with the spine edges of said sheets aligned to define a generally planar surface at generally a right angle to said opposite sides, each of said sheets, except for the outermost sheets in the stack which are each joined only along one of said edges, being joined at both of said edges to sheets adjacent its major side surfaces with the spine edges of the sheet being joined to the spine edge of the sheet along one of said side surfaces, and the outer edge of the sheet being joined to the outer edge of the sheet along the other of said side surfaces;

a pair of cover plates disposed on opposite sides of said stack and each having a spine edge aligned with the spine edges of the sheets in said stack;

a highly flexible strong backing having low resilience, said backing being a sheet material having a flexibility/stiffness of less than about 200 grams resistance to flexing when measured in accordance with the International Nonwoven Disposable Association Handle-O-Meter Stiffness Standard Test, IST 90.0-75 R-82, using a test sample of said sheet material 20.32 centimeter by 20.32 centimeter and having a slot into which said test centimeter wide and said test sample of sheet material is caused by the test to bend in an arc extending in the same direction along the test sample of material as the arcs around which the sheet material will have to bend to afford separation of the sheets in the bound stack; and a layer of pressure sensitive adhesive adhered to said backing at a coating weight of over about 15 grains per 24 square inches, which layer of pressure sensitive adhesive is adhered across the aligned spine edges of said sheets and cover plates;

said backing and layer of adhesive conforming closely to the spine edges of the sheets; and said backing having end portions adhered to portions of said cover plates adjacent said spine edges.

20. A bound book according to claim 19, wherein said backing is a nonwoven fabric having a flexibility/stiffness in the range of about 50 to 110 grams resistance to flexing when measured in accordance with the International Nonwoven Disposable Association Handle-O-Meter Stiffness Standard Test, IST 90.0-75 R-82 using a test sample of said nonwoven fabric 20.32 centimeter by 20.32 centimeter and having a slot into which said test sample of nonwoven fabric is pressed adjusted to be 0.635 centimeter wide and said test sample of nonwoven fabric is caused by the test to bend in an arc extending in the same direction along the test sample of fabric as the arcs around which the nonwoven fabric will have to bend to afford separation of the sheets in the bound stack.

21. A bound book according to claim 19, wherein said backing is a polymeric film having a flexibility/stiffness in the range of about 12 to 125 grams resistance to flexing when measured in accordance with the International Nonwoven Disposable Association Handle-O-Meter Stiffness Standard Test, IST 90.0-75 R-82 using a test sample of said film 20.32 centimeter by 20.32 centimeter and having a slot into which said test sample of film is pressed adjusted to be 0.635 centimeter wide and said test sample of film is caused by the test to bend in an arc extending in the same direction along the test sample of film as the arcs around which the film will have to bend to afford separation of the sheets in the bound stack.

22. A bound book according to claim 19 wherein said layer of pressure sensitive adhesive is an acrylic-macromer pressure sensitive adhesive at a coating weight of over about 30 grains per 24 square inches consisting of 100 parts by weight of a polymer consisting of 92 percent by weight of isooctyl acrylate, 4 percent by weight of acrylamide and 4 percent by weight of polystyrene macromer; and 40 parts by weight of a tackifier.

* * * * *

UNITED STATES PATENT AND TRADEMARK OFFICE

CERTIFICATE OF CORRECTION

PATENT NO. : 5,052,872

DATED : October 1, 1991

INVENTOR(S) : Ray A. Hunder, et al

It is certified that error appears in the above-indentified patent and that said Letters Patent is hereby corrected as shown below:

Col. 5, line 53 after "found" insert --to have release values in the range of 15 to 35 grams per--;

Col. 17, line 15 after "centimeter" insert --and having a lot into which said test sample of sheet material is pressed adjusted to be 0.635 centimeter--.

Signed and Sealed this

Fourteenth Day of June, 1994

Bruce Lehman

*Attest:*

BRUCE LEHMAN

*Attesting Officer*

*Commissioner of Patents and Trademarks*